US007690383B2

(12) United States Patent
Wada et al.

(10) Patent No.: US 7,690,383 B2
(45) Date of Patent: Apr. 6, 2010

(54) FLAVORING-MATERIAL APPLICATION DEVICE

(75) Inventors: Syuji Wada, Tokyo (JP); Takahiro Oba, Tokyo (JP); Takafumi Izumiya, Tokyo (JP); Junichi Nagai, Tokyo (JP); Narimasa Kaneda, Tokyo (JP); Manabu Yamada, Tokyo (JP)

(73) Assignee: Japan Tobacco Inc., Tokyo (JP)

( * ) Notice: Subject to any disclaimer, the term of this patent is extended or adjusted under 35 U.S.C. 154(b) by 384 days.

(21) Appl. No.: 11/896,257

(22) Filed: Aug. 30, 2007

(65) Prior Publication Data

US 2008/0053468 A1 Mar. 6, 2008

Related U.S. Application Data

(63) Continuation of application No. PCT/JP2005/018567, filed on Oct. 6, 2005.

(30) Foreign Application Priority Data

Mar. 2, 2005 (JP) ..... 2005-057727

(51) Int. Cl.
*A24C 5/54* (2006.01)

(52) U.S. Cl. ..... 131/34; 131/35; 131/37

(58) Field of Classification Search ..... 131/34, 131/35, 37; 118/61, 62, 68
See application file for complete search history.

(56) References Cited

U.S. PATENT DOCUMENTS 2,543,277 A * 2/1951 Copeman ..... 131/61.1
2,823,640 A * 2/1958 Whitbeck ..... 118/64
4,132,189 A * 1/1979 Greve et al. ..... 118/674
4,567,752 A * 2/1986 Labbe ..... 73/37.6
4,575,368 A * 3/1986 Sagawa et al. ..... 493/49
5,797,406 A * 8/1998 Dawson ..... 131/84.1
7,243,656 B2 * 7/2007 Kushihashi et al. ..... 131/60
7,275,548 B2 * 10/2007 Hancock et al. ..... 131/35
7,276,120 B2 * 10/2007 Holmes ..... 118/325
7,300,394 B2 * 11/2007 Buhl et al. ..... 493/46

(Continued)

FOREIGN PATENT DOCUMENTS

JP 2000-96493 A 4/2000

(Continued)

*Primary Examiner*—Carlos Lopez
(74) *Attorney, Agent, or Firm*—Birch, Stewart, Kolasch & Birch, LLP

(57) ABSTRACT

A cigarette making apparatus includes a cooling-water passage which allows a coolant to circulate along a flavoring-material supply path which connects an application nozzle for applying a flavoring material to a wrapping-paper web and a pump for supplying the flavoring material to the application nozzle, to thereby cool the flavoring material. A cooling unit controls the temperature of the coolant supplied to the cooling-water passage. Specifically, the cooling unit controls the temperature of the flavoring material by selectively activating a first control system for detecting the temperature of the coolant supplied to the cooling-water passage and controlling the temperature of the coolant, and a second control system for detecting the temperature of the flavoring material supplied to the application nozzle and controlling the temperature of the coolant. Since the temperature of the flavoring material is controlled to fix the viscosity thereof, the amount per unit area of the flavoring material applied to the wrapping-paper web is fixed only by controlling the drive of the pump depending on the rate of supply of the wrapping-paper web.

6 Claims, 5 Drawing Sheets

U.S. PATENT DOCUMENTS

| | | | | |
|---|---|---|---|---|
| 7,363,929 | B2 * | 4/2008 | Fagg et al. | 131/35 |
| 2004/0118416 | A1 | 6/2004 | Seymour et al. | |
| 2005/0076925 | A1 * | 4/2005 | Fagg et al. | 131/60 |
| 2006/0207617 | A1 * | 9/2006 | Seymour et al. | 131/284 |
| 2006/0252622 | A1 * | 11/2006 | Kato | 493/39 |
| 2008/0288346 | A1 * | 11/2008 | Shames | 705/14 |
| 2009/0183836 | A1 * | 7/2009 | Riedel | 156/379.6 |

FOREIGN PATENT DOCUMENTS

| | | | |
|---|---|---|---|
| JP | 2003-27395 | A | 1/2003 |
| RU | 1836039 | A3 | 8/1993 |
| RU | 2 109 468 | C1 | 4/1998 |
| RU | 2 214 142 | C2 | 10/2003 |
| UA | 45336 | C2 | 4/2002 |
| WO | WO-03/013284 | A1 | 2/2003 |
| WO | WO-03/061410 | A1 | 7/2003 |
| WO | WO-2004/064546 | A1 | 8/2004 |
| WO | WO-2006/092881 | A1 | 9/2006 |

* cited by examiner

FLAVORING-MATERIAL APPLICATION DEVICE

This application is a Continuation of copending PCT International Application No. PCT/JP2005/018567 filed on Oct. 6, 2005, which designated the United States, and on which priority is claimed under 35 U.S.C. §120. This application also claims priority under 35 U.S.C. §119(a) on Patent Application No(s). 2005-057727 filed in Japan on Mar. 2, 2005. The entire contents of each of the above documents is hereby incorporated by reference.

TECHNICAL FIELD

This invention relates to a cigarette making apparatus for manufacturing cigarettes by applying a flavoring material to a wrapping-paper web continuously supplied to a wrapping machine.

BACKGROUND ART

A wrapping machine used in manufacture of cigarettes is presented in detail in published U.S. Patent Application No. 2004/0118416 A1, for example. In this wrapping machine, a wrapping-paper web continuously supplied is supported and conveyed length ways by a garniture tape, and on the upper side of this wrapping-paper web, a controlled amount of shredded tobacco is disposed. Then, by continuously wrapping the shredded tobacco in the wrapping-paper web by bending both sides of the wrapping-paper web, a continuous tobacco rod is continuously formed. During this process, seam glue for sticking together the opposite side ends of the wrapping-paper web wrapped around the shredded tobacco is applied to one side end of the wrapping-paper web continuously supplied to the wrapping machine.

International Patent Publication No. 2004/064546 discloses application of a flavoring material for suppressing a particular smell of cigarettes without harming the taste thereof, to a wrapping-paper web. The flavoring material of this type is, for example, a liquid prepared by dissolving a flavoring substance in a CMC (carboxymethylcellulose) aqueous solution or a benzine alcohol suspension. The amount of the flavoring material applied to the wrapping-paper web is great, compared with the seam glue. Further, the amount of the flavoring material applied to the wrapping-paper web affects the quality of the cigarettes manufactured. Thus, it is necessary to control the amount of the flavoring material applied, accurately.

Meanwhile, the speed of supply of the wrapping-paper web to the wrapping machine is varied depending on the operating speed of the wrapping machine, namely the speed at which the wrapping machine forms a continuous tobacco rod. Thus, when the flavoring material is applied to the wrapping-paper web while the continuous tobacco rod is being formed, it is important to adjust the rate of supply of the flavoring material to an application nozzle depending on the traveling speed of the wrapping-paper web (speed of supply of the wrapping-paper web) so that the flavoring material will be applied to the wrapping-paper web in a fixed amount per unit area. There is, however, observed a problem that although the operation of a pump for supplying the flavoring material to the flavoring-material application nozzle is controlled depending on the speed of supply of the wrapping-paper web so that the flavoring material will be applied to the wrapping-paper web in a fixed amount per unit area, the amount per unit area of the flavoring material applied to the wrapping-paper web gradually increases.

DISCLOSURE OF THE INVENTION

The primary object of this invention is to provide a cigarette making apparatus which can always and stably apply a flavoring material to a wrapping-paper web continuously supplied to a wrapping machine, in a fixed amount per unit area, thereby stabilizing the quality of cigarettes manufactured.

Investigating the cause of the phenomenon in the conventional apparatus that although the rate of supply of the flavoring material is controlled depending on the speed of supply of the wrapping-paper web, the amount per unit area of the flavoring material applied to the wrapping-paper web gradually increases, the inventors have found out that this phenomenon is exclusively due to the reason that a rise in machine temperature during the operation of the cigarette making apparatus causes a rise in temperature of the flavoring material, which results in a decrease in viscosity of the flavoring material. The present invention therefore pays attention to the viscosity of the flavoring material. Specifically, the present invention keeps the flavoring material at a fixed viscosity, thereby enabling the flavoring material to be applied to the wrapping-paper web in a fixed amount per unit area only by controlling the rate of supply of the flavoring material depending on the rate of supply of the wrapping-paper web.

The present invention provides a cigarette making apparatus comprising a wrapping machine for continuously wrapping shredded tobacco in a wrapping-paper web by bending both sides of the wrapping-paper web; and a flavoring-material application device for applying a flavoring material to the wrapping-paper web, provided in a path along which the wrapping-paper web is supplied to the wrapping machine, as a stage prior to applying seam glue, wherein the flavoring-material application device includes, in addition to an application nozzle for applying the flavoring material to the wrapping-paper web and a pump driven to rotate to supply the flavoring material to the application nozzle, a cooling-water passage which allows a coolant to circulate along a flavoring-material supply passage through which the flavoring material is supplied by the pump, thereby cooling the flavoring material, and a cooling unit for controlling the temperature of the coolant supplied to the cooling-water passage.

Specifically, in the present invention, a cooling-water passage is provided along a flavoring-material supply pipe (flavoring-material supply passage) through which a flavoring material is supplied from a flavoring-material tank to an application nozzle by means of a pump, so that the flavoring material can be cooled by a coolant (cooling water) flowing through the cooling-water passage, and also a cooling unit for controlling the temperature of the coolant (cooling water) is provided. Since the temperature of the flavoring material is fixed in spite of variations in machine temperature because of the provision of this cooling-water passage, the amount per unit area of the flavoring material applied to the wrapping-paper web is fixed only by controlling the rate of supply of the flavoring material depending on the rate of supply of the wrapping-paper web.

In the cigarette making apparatus arranged as described above, since the temperature of the flavoring material can be controlled by means of the cooing water passage which is controlled in temperature by the cooling unit, the flavoring material supplied to the application nozzle can be kept at a fixed temperature in spite of variations in machine temperature. Consequently, variations in viscosity of the flavoring material are suppressed, so that the flavoring material applied to the wrapping-paper web by the application nozzle can be easily controlled to a fixed amount per unit area only by controlling the drive of the pump. Since the flavoring material is kept at a fixed temperature and therefore the amount per unit area of the flavoring material can be stably controlled only by controlling the drive of the pump, the quality of cigarettes manufactured can be maintained easily and stably.

Desirably, the cooling unit should include a first control system for detecting the temperature of the coolant supplied to the cooling-water passage and controlling the temperature of the coolant on the basis of the detected temperature of the coolant, and a second control system for detecting the temperature of the flavoring material supplied to the application nozzle and controlling the temperature of the coolant on the basis of the detected temperature of the flavoring material. In this case, the cooling unit performs drive control by activating the first control system while the wrapping machine is at rest, and activating the second control system while the wrapping machine is operating.

By controlling the temperature of the coolant by selecting between the control systems depending on the operating state of the cigarette making apparatus, the cooling unit can stably and efficiently control the flavoring material to a fixed temperature, with a burden reduced.

In one aspect, the cooling-water passage includes a coolant passage pipe which surrounds the outside of the flavoring-material supply pipe to form a double-pipe structure, and is used for the coolant to flow from the application-nozzle side to the pump side. This structure makes it possible to fix the temperature of the flavoring material in the application nozzle, which directly affects the amount per unit area of the flavoring material applied, and also reduce a rise in temperature of the flavoring material before supplied to the application nozzle, by utilizing the excess capacity (cooling capacity) of the coolant. This can increase the efficiency of cooling the flavoring material.

The flavoring material is, for example a liquid prepared by dissolving powder containing a flavoring substance in a CMC (carboxymethylcellulose) aqueous solution or a benzine alcohol suspension.

BEST MODE OF CARRYING OUT THE INVENTION

Figure 1:
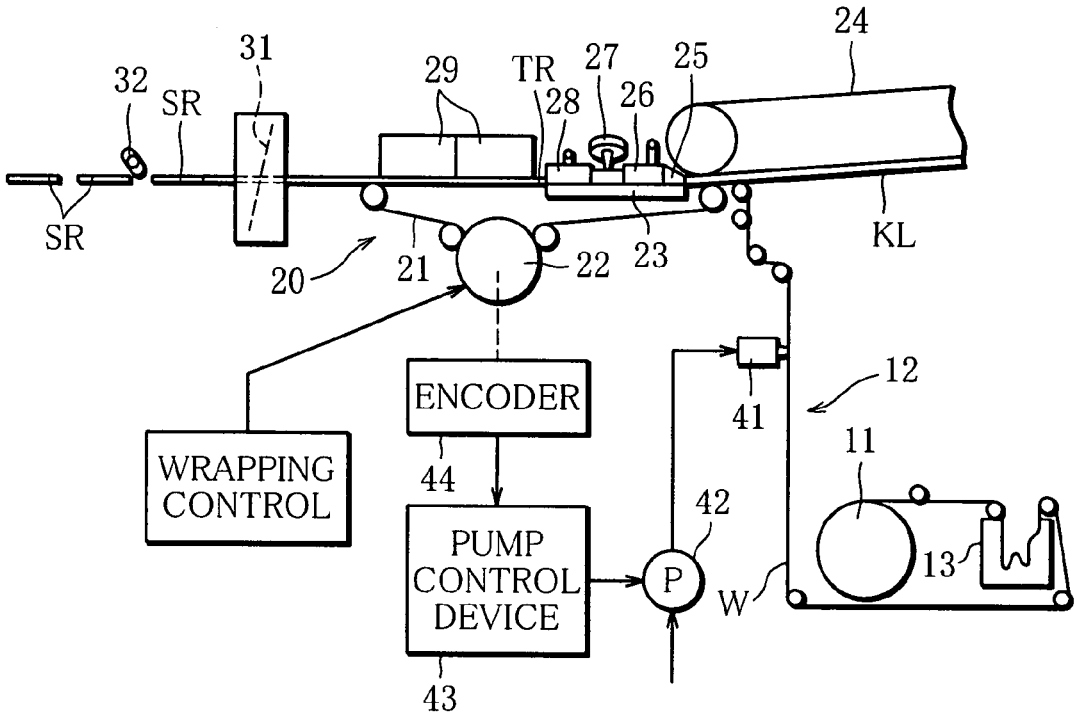
FIG. 1 A diagram showing schematic structure of an embodiment of cigarette making apparatus according to the present invention.

Referring to the drawings, an embodiment of cigarette making apparatus according to the present invention will be described below.

FIG. 1 shows a schematic structure of a cigarette making apparatus. A roll 11 of a wrapping-paper web W of a determined width is provided to the cigarette making apparatus so that the wrapping-paper web W is fed from the roll 11 along a feed path 12. The feed path 12 is defined by a plurality of guide rollers 13, and the terminal end of the feed path 12 is adjacent to the entry of a wrapping machine 20. The feed path 12 includes feed rollers (not shown) and a reservoir 13. The reservoir 13 is provided for "buffering", namely storing a determined length of the wrapping-paper web W to give time for joining a wrapping-paper web W of a subsequent roll 11 to the previous wrapping-paper web W.

The wrapping machine 20 includes an endless garniture tape 21. The wrapping-paper web W is fed from the terminal end of the feed path 12 to the garniture tape 21, continuously. The garniture tape 21 is passed around a drive drum 22 to form a round path. As the drive drum 22 rotates, the garniture tape travels with the wrapping-paper web W, in a forming groove (not shown) in a forming bed 23, in one direction. The forming groove in the forming bed 23 has a shape such that it gradually decreases in width and radius of curvature of the bottom, from the entry to the exit of the wrapping machine 20, and has an approximately half-round cross-section at the exit of the wrapping machine 20.

At the entry of the wrapping machine 20, shredded tobacco K is supplied onto the upper side of the wrapping-paper web W. More specifically, shredded tobacco K is sucked onto the lower side of an endless tobacco band 24 to form a shredded tobacco layer KL, which is conveyed to the entry of the wrapping machine 20 as the tobacco band 24 travels. The shredded tobacco layer KL retained on the tobacco band 24 by suction is taken off the tobacco band 24 and transferred onto the wrapping-paper web W by a tong shoe 25 disposed at the entry of the wrapping machine 20.

After the shredded tobacco layer KL is supplied onto the wrapping-paper web W in this manner, the wrapping-paper web W with the shredded tobacco layer KL on is conveyed into the wrapping machine 10, and passes through the tong shoe 25, a short holder 26, a glue application nozzle 27 and a long holder 28, which are provided in the wrapping machine 10, successively. In this process, the shredded tobacco K is wrapped in the wrapping-paper web W so that a continuous tobacco rod TR is formed continuously. The tobacco rod TR formed is sent out from the exit of the wrapping machine 10.

More specifically, the tong shoe 25 compresses the shredded tobacco layer KL from above, thereby forming it to describe an arc in cross-section, while the forming groove in the forming bed 23 bends the wrapping-paper web W into a U-like cross-section, from below, with the garniture tape 21. Thus, the shredded tobacco layer KL is compressed from above and from below, and thereby formed to describe upper and lower arcs in cross-section. The short holder 26 bends one side of the wrapping-paper web W into an arc, with the garniture tape 21, so that one half of the upper half of the shredded tobacco layer KL is covered with this part of the wrapping-paper web. At this time, the glue application nozzle 27 applies seam glue to the other side end of the wrapping-paper web W. Then, the long holder 28 bends this other side of the wrapping-paper web W into an arc, with the garniture tape 21, so that the other half of the upper half of the shredded tobacco layer KL is covered with this part of the wrapping-paper web W. Consequently, one side end of the wrapping-paper web W comes on the other side end and they are stuck together by the seam glue, so that the tobacco rod TR is formed.

The tobacco rod TR sent out from the exit of the wrapping machine 20 passes under a heater 29, where the seam glue is dried. Then, the tobacco rod TR is cut by a rotary knife 31 in a cutting section, into cigarette rods SR of a determined length, namely twice the length of a cigarette. The cigarette rods SR are supplied to the next stage (next step), namely a filter attachment machine (not shown) by a kicker 32.

In the filter attachment machine, one cigarette rod SR is cut into two cigarettes, and a filter plug is disposed between the two cigarettes, coaxially. Then a tip paper piece is wrapped around them to cover the filter plug and the adjacent ends of the cigarettes, so that the two cigarettes and filter plug are joined together to form a double filter-cigarette. Then, by cutting the double filter-cigarette at the center of the filter plug, into two equal parts, two filtered cigarettes are formed.

In the cigarette making apparatus basically having the above-described configuration, a flavoring-material application device for applying a flavoring material to the wrapping-paper web W is disposed, for example in the feed path 12, downstream of the reservoir 13, as a stage prior to the application of the seam glue. The flavoring-material application device includes an application nozzle 41 for applying a flavoring material in liquid form to the inside surface of the wrapping-paper web W, with a determined width, and a pump 42 for supplying the flavoring material to the application nozzle 41.

The application nozzle 41 applies the flavoring material linearly by discharging the flavoring material from the distal end of the nozzle onto the surface of the wrapping-paper web W intended for application of the flavoring material. The rate of discharge of the flavoring material from the application nozzle 41 is controlled by the rate of supply of the flavoring material from the pump 42. The rate of supply of the flavoring material is controlled by the pump 42 driving speed controlled by a pump control device 43, or in other words, the rotating speed of the pump 42. Specifically, receiving output of an encoder 44 for detecting the rotating speed of the drive drum 22, the pump control device 43 controls the rotating speed of the pump 42 depending on the speed at which the wrapping machine 20 forms the tobacco rod, or in other words, the operating speed of the wrapping machine 20, as described later. By controlling the rotating speed of the pump 42 this way, the rate of supply of the flavoring material to the application nozzle 41 and hence the rate of application of the flavoring material to the wrapping-paper web W is controlled.

The flavoring material (flavoring mixture) applied to the wrapping-paper web W in the above-described manner is, for example for alleviating or masking an unpleasant smell of a cigarette smoked, smell of sidestream smoke, in particular. Specifically, the flavoring material contains one or more flavoring substances selected from a group consisting of terpenes, esters, alcohols such as linalool, nerol and geraniol, phenols such as anethole, aldehydes such as vanillin and ethyl vanillate, lactones, plant extracts, fruit extracts, etc. The flavoring material may contain any of substances as disclosed in Japanese Unexamined Patent Publication No. 2002-146386. The flavoring material is prepared, for example by dissolving powder containing a flavoring substance as mentioned above in a CMC (carboxymethylcellulose) aqueous solution or a benzine alcohol suspension. Specifically, a flavoring material prepared by dissolving flavoring powdered capsules in an approximately 80 weight % CMC alcohol aqueous solution or a benzine alcohol suspension is used.

Figure 2:
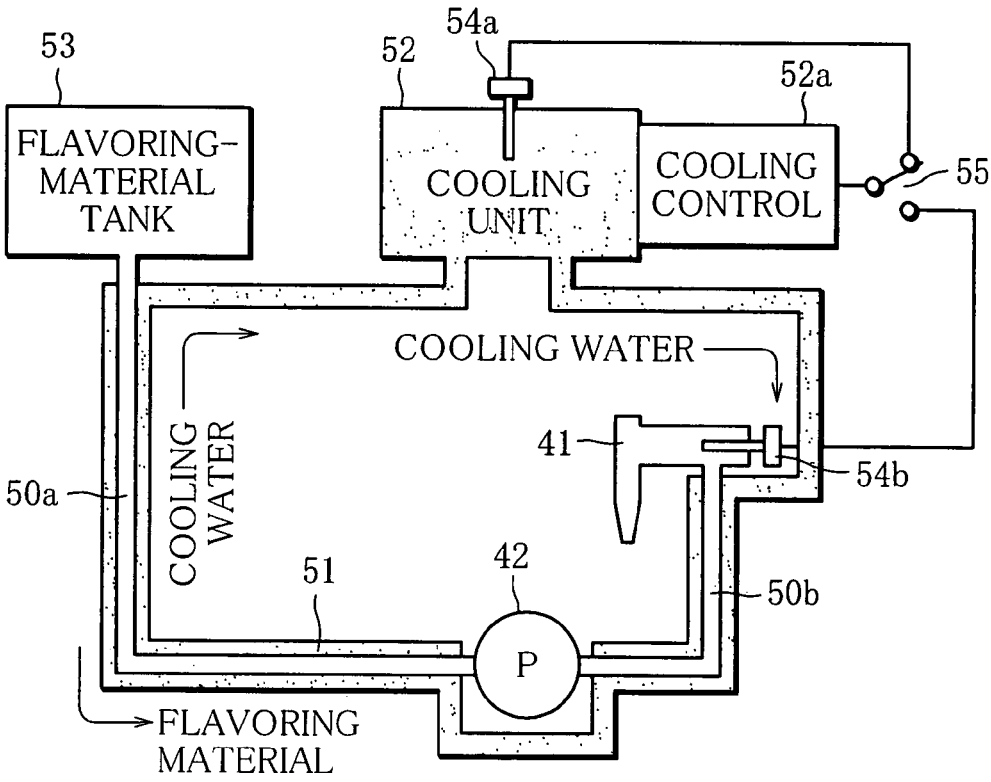
FIG. 2 A diagram showing schematic structure of a flavoring-material application device incorporated in the cigarette making apparatus shown in FIG. 1.

In the cigarette making apparatus basically having the above-described configuration, the present invention is characterized by the specific structure of the flavoring-material application device. As seen from FIG. 2 showing the schematic structure thereof, the flavoring-material application device includes, as basic functional components, an application nozzle 41 and a pump 42 for supplying the flavoring material to the application nozzle 41. This flavoring-material application device is characterized by further including a cooling-water passage 51 which allows a coolant to circulate along a flavoring-material passage 50 through which the flavoring material is supplied by the pump 42, thereby cooling the flavoring material, and a cooling unit 52 for controlling the temperature of the coolant supplied to the cooling-water passage 51.

In the flavoring-material application device, the primary side (source side) of the pump 42 is connected to a flavoring-material tank 53 by a first feed pipe 50*a*, and the secondary side (drain side) of the pump 42 is connected to the application nozzle 41 by a second feed pipe 50*b*. The feed pipes 50*a*, 50*b* constitute the above-mentioned flavoring-material supply passage 50. The cooling-water passage 51 consists of pipes which surround the feed pipes 50*a*, 50*b* to form a double pipe structure, and auxiliary pipes used to connect those pipes and the cooling unit 52 in series. The cooling-water passage 51 allows the cooling water (coolant) discharged from the cooling unit 52 to circulate along the flavoring-material supply passage 50, thereby cooling the flavoring material. Specifically, the cooling-water passage 51 provides a circulation path along which the cooling water sent out from the cooling unit 52 is supplied to the application-nozzle-41 side, flows toward the pump 42, in the direction opposite to the direction of supply of the flavoring material, and returns from the flavoring-material-tank-53 side to the cooling unit 52.

The cooling unit 25 includes a cooler which, under the control by a cooling control section 52*a*, draws heat from the cooling water to drop the temperature thereof, on the basis of the temperature detected by first and second temperature sensors 54*a*, 54*b*. Specifically, the first temperature sensor 54*a* is provided to detect the temperature of the cooling water in the cooling unit 52, while the second temperature sensor 54*b* is provided to detect the temperature of the flavoring material in the application nozzle 41. The temperature information obtained by the temperature sensors 54*a*, 54*b* is selectively provided to the cooling control section 53 depending on the operating state of the wrapping machine 20.

Specifically, the cooling control section 52*a* includes a first control system for controlling the temperature of the cooling water sent out from the cooling control unit 52 on the basis of the temperature of the cooling water detected by the first temperature sensor 54*a*, and a second control system for controlling the temperature of the cooling water sent out from the cooling control unit 52 on the basis of the temperature of the flavoring material supplied to the application nozzle 41, detected by the second temperature sensor 54*b*. By selectively activating the first and second control systems, the cooling control section 52*a* controls the temperature of the cooling water depending on the operating state of the cigarette making apparatus 20.

Figure 3:
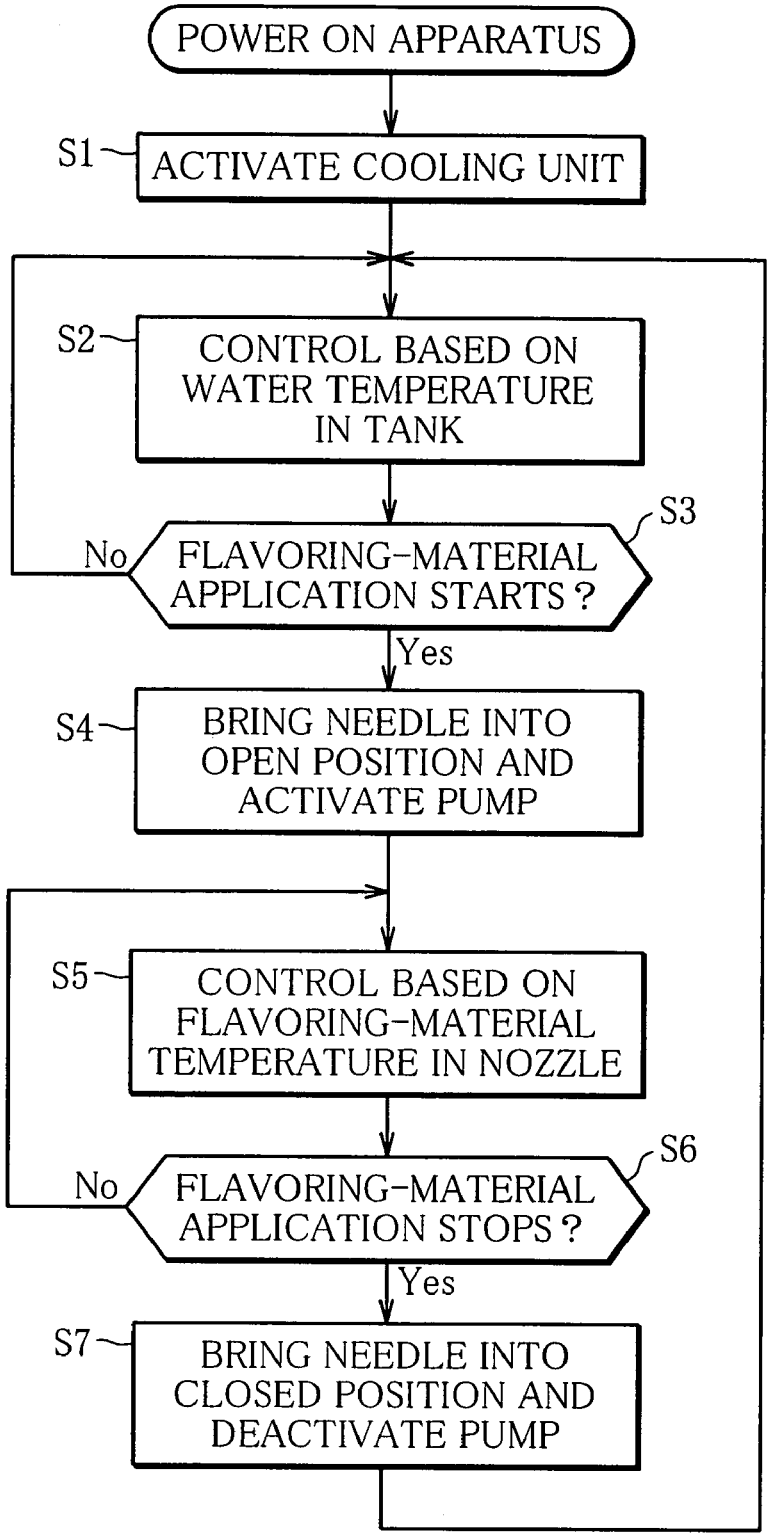
FIG. 3 A diagram showing an example of a cooling control process performed in the flavoring-material application device shown in FIG. 2.

FIG. 3 schematically shows the control process performed in the cooling control system constructed as described above. When the cigarette making apparatus is powered on, the cooling control unit 52 is activated so that the control starts <Step S1>. First, the cooling control section controls the temperature of the cooling water sent out from the cooling control unit 52 on the basis of the temperature of the cooling water detected by the first temperature sensor 54*a* <Step S2>.

Under such control on the operation of the cooling unit 52, by means of the cooling water circulating through the cooling-water passage 51, the flavoring material supplied through the flavoring-material supply passage 50 is kept approximately at the temperature of the cooling water, in spite of variations in machine temperature around.

After this preparation, the cigarette making apparatus starts operation, and when an instruction to start the application of the flavoring material is given, a needle (not shown) of the application nozzle 41 is brought into an open position, and at the same time, the pump 42 is activated <Steps S3, S4>. By the pump 42 activated, the flavoring material is supplied from the flavoring-material tank 51 to the application nozzle 41, so that the application nozzle 41 starts to apply the flavoring material to the wrapping-paper web W. When the cigarette making machine transfers to the flavoring-material application operation, the cooling control section activates the second control system in place of the first control system, to control the temperature of the cooling water sent out from the cooling control unit 52 on the basis of the temperature of the flavoring material in the application nozzle 41, detected by the second temperature sensor 54*b* <Step S5>. Specifically, since the temperature of the flavoring material in the application nozzle 41 is determined primarily by the temperature of the cooling water near the application nozzle 41, the temperature of the cooling water sent out from the cooling unit 52 is controlled so that the cooling water near the application nozzle 41 is at a predetermined temperature.

This cooling-water temperature control by the second control system continues until the flavoring-material application operation is stopped <Step S6>. When the flavoring-material application operation is stopped, the needle of the application nozzle 41 is brought into a closed position, and at the same time, the pump 42 is deactivated <Step S7>. Then, the cooling control section returns to the cooling-water temperature control by the first control system at Step S2. It is to be noted that the stop of the flavoring-material application operation mentioned above means a temporary rest of the cigarette making apparatus, for example in brake time of a factory.

In the cigarette making apparatus arranged, as described above, to cool the flavoring material supplied to the application nozzle 41 by means of the cooling water circulating through the cooling-water passage provided along the flavoring-material supply passage 50, even when the machine temperature rises while the apparatus is operating, the flavoring material can be kept at a fixed temperature in spite of the rise in machine temperature. Thus, variation in viscosity of the flavoring material due to variation in temperature is prevented, and therefore, the flavoring material applied from the application nozzle 41 to the wrapping-paper web W can be stably controlled to a fixed amount per unit area, only by controlling the rate of supply of the flavoring material to the application nozzle 41 by controlling the rotating speed of the pump 42.

Further, while the flavoring-material application operation is suspended, by detecting the temperature of the cooling water and controlling it to be a predetermined temperature, the entire flavoring-material application device can almost be kept at a low temperature without being affected by the machine temperature around. Meanwhile, during the flavoring-material application operation, it is sufficient to control the flavoring material to keep a fixed temperature, by controlling the temperature of the cooling water accurately, on the basis of the temperature of the flavoring material in the application nozzle 41. Thus, the control system does not need to have an excessively complex configuration. Since the flavoring material can be kept at a fixed viscosity by controlling the temperature of the flavoring material in a simple and effective manner, the amount per unit area of the flavoring material applied to the wrapping-paper web W can be fixed in spite of variations in machine temperature around. Thus, the quality of the cigarettes manufactured can be easily stabilized.

Figure 4:
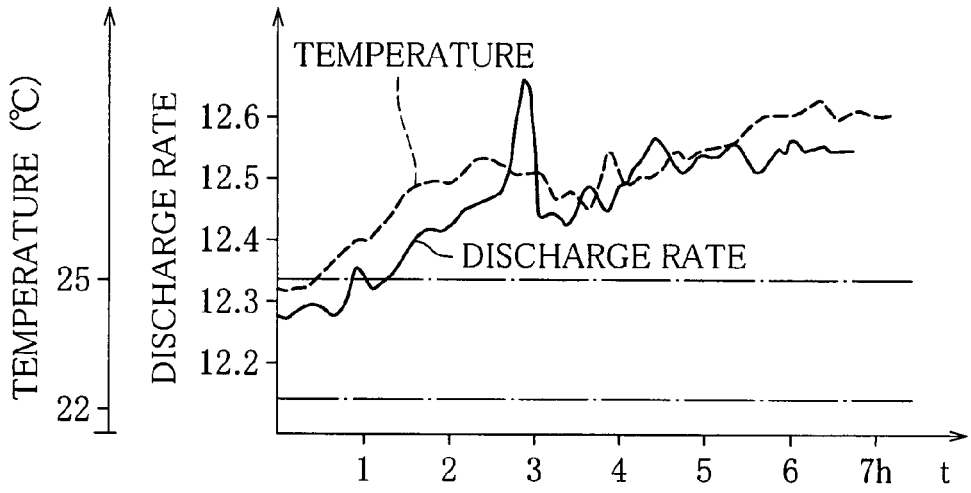
FIG. 4 A diagram showing how the temperature of a flavoring material and the rate of discharge of the flavoring material from an application nozzle vary with time, when the cigarette making apparatus operates without utilizing a cooling-water passage.
Figure 5:
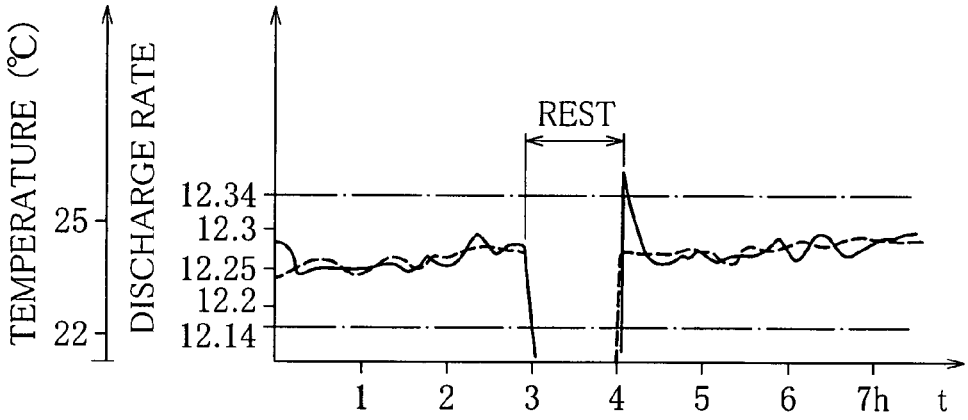
FIG. 5 A diagram showing how the temperature of the flavoring material and the rate of discharge of the flavoring material from the application nozzle vary with time, when the cigarette making apparatus operates keeping the coolant at a fixed temperature.
Figure 6:
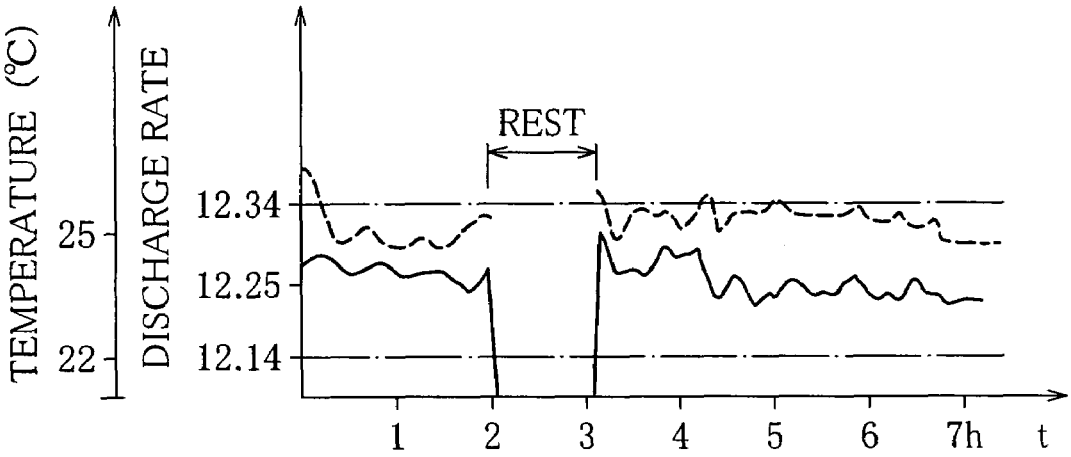
FIG. 6 A diagram showing how the temperature of the flavoring material and the rate of discharge of the flavoring material from the application nozzle vary with time, when the cigarette making apparatus operates keeping the flavoring material at a fixed temperature.

In order to confirm the positive effect of the flavoring-material application device having the above-described cooling water passage 51, how the temperature of the flavoring material and the rate of discharge of the flavoring material from the application nozzle 41 vary with time, during the operation of the cigarette making apparatus was investigated. The results obtained are shown in FIGS. 4 to 6. FIG. 4 shows characteristics when the cooling water passage 51 was not utilized. FIG. 5 shows characteristics when the cooling water was kept at a fixed temperature (25° C.) by utilizing the cooling water passage 51. FIG. 6 shows characteristics when the temperature of the cooling water was controlled on the basis of the temperature of the flavoring material in the application nozzle 42, so as to keep the flavoring material at 25° C. In FIGS. 4 to 6, average variation in rate of discharge of the flavoring material is shown in solid line, while average variation in temperature of the flavoring material in the application nozzle 41 is shown in dashed line.

As clear from the comparison between FIGS. 4, 5, and 6 showing the variation in temperature of the flavoring material and the variation in rate of discharge of the flavoring material, in the conventional, common flavoring-material application device without the cooling water passage 51, the temperature of the flavoring material is affected by the machine temperature around and begins to rise about an hour after the machine starts operating, so that the amount per unit area of the flavoring material applied increases over a determined value. Meanwhile, in the flavoring-material application device provided with the cooling water passage 51, the rise in temperature of the flavoring material can be suppressed effectively even when the machine temperature around rises. However, when only the cooling water is controlled to a fixed temperature, a temporary increase in rate of discharge of the flavoring material can happen when the machine operation is resumed after a rest, as shown in FIG. 5. Meanwhile, it was confirmed that in the arrangement where the temperature of the cooling water passage is controlled on the basis of the temperature of the flavoring material in the application nozzle 41, the rate of discharge of the flavoring material can be kept within a determined allowable range even when the machine operation is resumed after a rest, as shown in FIG. 6.

The temporary increase in rate of discharge of the flavoring material at the time of resuming the operation, observed in the case where the temperature of the cooling water is detected and controlled to be fixed, is thought to be due to the following reason: During the rest, the temperature of the cooling water sent out from the cooling unit 52 can be fixed. However, the temperature of the cooling water flowing in the cooling water passage 51 is affected by the machine temperature around, and gradually rises, so that, near the application nozzle 41 and near the pump 42, the cooling-water temperature exceeds the control target temperature. Thus, the flavoring material which fills the supply passage 52 and stays still while the flavoring-material application operation is suspended rises in temperature, although not to a great degree. Consequently, when the machine operation is resumed after the rest, the flavoring material temporarily decreased in viscosity is supplied to the application nozzle 41, which results in an increase in rate of discharge of the flavoring material. In contrast, when, as described above, the temperature of the flavoring material in the application nozzle 41 is detected and the temperature of the cooling water is controlled on the basis of the detected temperature of the flavoring material, the temperature of the flavoring material discharged from the application nozzle 41 to the wrapping-paper web W can be fixed. Thus, the rate of discharge of the flavoring material from the application nozzle 41 can be easily controlled to be fixed. For this reason, it is very useful to control the temperature of the flavoring material by switch between the two control systems as described above.

The present invention is not limited to the above-described embodiment. For example, although in the example described, the flavoring material is applied to the wrapping-paper web P in the pattern of a longitudinal line, the present invention is applicable to the case where the flavoring material is applied to the wrapping-paper web in the pattern of two or more longitudinal lines with a determined space between. Further, although the example in which single wrapper cigarettes, namely cigarettes with one wrapper W enclosing shredded tobacco K, are manufactured has been taken, the present invention is applicable to the manufacture of double wrapper cigarettes, namely cigarettes with two wrappers W enclosing shredded tobacco K, likewise. In the case of the double wrapper cigarettes, it can be arranged such that the flavoring material is applied between the two layered wrappers W, namely on the inside, or joint surface of one of the two layered wrappers W. Further, in place of the cooling water, a variety of coolants can be used to cool the flavoring material, and the cooling unit 52 is not limited to a particular structure. In other respects, the present invention can be modified in various ways, without deviating from its scope.

The invention claimed is:

1. A cigarette making apparatus comprising a wrapping machine for continuously wrapping shredded tobacco in a wrapping-paper web by bending both sides of the wrapping-paper web, and a flavoring-material application device for applying a flavoring material to the wrapping-paper web, provided in a path along which the wrapping-paper web is supplied to the wrapping machine, as a stage prior to applying seam glue, wherein the flavoring-material application device includes an application nozzle for applying the flavoring material to the wrapping-paper web, a pump driven to rotate to supply the flavoring material to the application nozzle, a cooling-water passage which allows a coolant to circulate along a flavoring-material supply passage through which the flavoring material is supplied by the pump, thereby cooling the flavoring material, and a cooling unit for controlling the temperature of the coolant supplied to the cooling-water passage.

2. The cigarette making apparatus according to claim 1, wherein the cooling unit includes a first control system for detecting the temperature of the coolant supplied to the cooling-water passage and controlling the temperature of the coolant on the basis of the detected temperature of the coolant, and a second control system for detecting the temperature of the flavoring material supplied to the application nozzle and controlling the temperature of the coolant on the basis of the detected temperature of the flavoring material.

3. The cigarette making apparatus according to claim 2, wherein the first control system detects the temperature of the coolant by means of a first sensor provided to the cooling unit, and the second control system detects the temperature of the coolant by means of a second sensor incorporated in the application nozzle.

4. The cigarette making apparatus according to claim 2, wherein the cooling unit activates the first control system while the wrapping machine is at rest, and activates the second control system while the wrapping machine is operating.

5. The cigarette making apparatus according to claim 1, wherein the cooling water passage includes a coolant passage pipe which surrounds the outside of a flavoring-material supply pipe through which the flavoring material is supplied, and allows the coolant to flow from the application-nozzle side to the pump side.

6. The cigarette making apparatus according to claim 1, wherein the flavoring material is a liquid prepared by dissolving powder containing a flavoring substance in a CMC (carboxymethylcellulose) aqueous solution or a benzine alcohol suspension.

* * * * *